US007946332B2

(12) United States Patent
Hörmann et al.

(10) Patent No.: US 7,946,332 B2
(45) Date of Patent: May 24, 2011

(54) GATE

(75) Inventors: Thomas J. Hörmann, St. Wendel (DE); Michael Brinkmann, Halle (DE)

(73) Assignee: Hormann KG Brockhagen, Steinhagen (DE)

( * ) Notice: Subject to any disclaimer, the term of this patent is extended or adjusted under 35 U.S.C. 154(b) by 254 days.

(21) Appl. No.: 11/088,224

(22) Filed: Mar. 23, 2005

(65) Prior Publication Data

US 2005/0224195 A1 Oct. 13, 2005

(30) Foreign Application Priority Data

Mar. 23, 2004 (DE) ..... 10 2004 014 182

(51) Int. Cl.
*E05D 15/26* (2006.01)

(52) U.S. Cl. ..... 160/116; 160/7; 160/40; 49/26; 49/270

(58) Field of Classification Search ..... 160/201, 160/229.1, 209, 189, 188, 7, 116, 180, 40; 49/26, 27, 28, 483.1, 484.1, 470
See application file for complete search history.

(56) References Cited

U.S. PATENT DOCUMENTS

| | | | | | |
|---|---|---|---|---|---|
| 1,989,657 | A | * | 1/1935 | McCloud | 160/116 |
| 2,017,012 | A | * | 10/1935 | Morgan | 160/190 |
| 4,854,365 | A | * | 8/1989 | Juneau | 160/232 |
| 4,953,608 | A | * | 9/1990 | Larsson | 160/1 |
| 5,233,185 | A | * | 8/1993 | Whitaker | 250/222.1 |
| 5,365,993 | A | * | 11/1994 | Jella | 160/201 |
| 5,399,851 | A | * | 3/1995 | Strand | 250/222.1 |
| 5,428,923 | A | * | 7/1995 | Waggamon | 49/28 |
| 5,508,511 | A | * | 4/1996 | Zur et al. | 250/222.1 |
| 5,577,541 | A | * | 11/1996 | McKeon | 160/7 |
| 5,673,740 | A | * | 10/1997 | Park | 160/116 |
| 5,749,407 | A | * | 5/1998 | Brenner et al. | 160/229.1 |
| 6,006,814 | A | * | 12/1999 | Dalpe | 160/116 |
| 6,082,046 | A | * | 7/2000 | Simmons | 49/26 |
| 6,161,606 | A | * | 12/2000 | Wegner et al. | 160/229.1 |
| 6,176,039 | B1 | * | 1/2001 | Craig | 49/26 |
| 6,612,357 | B1 | * | 9/2003 | Beringer et al. | 160/10 |
| 6,651,385 | B2 | * | 11/2003 | Miller et al. | 49/27 |
| 6,655,440 | B2 | * | 12/2003 | Brunk | 160/40 |
| 6,662,499 | B1 | * | 12/2003 | Shin et al. | 49/26 |
| 6,920,717 | B2 | * | 7/2005 | Miller et al. | 49/27 |
| 2003/0141023 | A1 | * | 7/2003 | Griebel | 160/180 |

FOREIGN PATENT DOCUMENTS

| | | |
|---|---|---|
| EP | 0 304 642 | 4/1992 |
| EP | 0 370 376 | 7/1994 |
| WO | 01/55543 | 8/2001 |

* cited by examiner

*Primary Examiner* — David Purol
(74) *Attorney, Agent, or Firm* — Schwabe, Williamson & Wyatt, P.C.

(57) ABSTRACT

A gate includes a gate leaf which is movable between a closed and an open position, and a plurality of gate leaf elements, which are tiltable. The gate leaf includes a door leaf which is swingable around a pivot axis extending perpendicular to the tilt axes. When closed, the door leaf is mounted in an opening in the gate leaf and the door leaf extends essentially parallel to the plane of the gate leaf. A stabilizing arrangement opposes the deformation of the gate leaf and a threshold element which rests on the floor of the opening when the gate leaf is in the closed position. The height of the threshold element is essentially less than 20 mm, preferably less than 10 mm.

43 Claims, 13 Drawing Sheets

GATE

BACKGROUND OF THE INVENTION

1. Field of the Invention

The present invention relates to a gate with a gate leaf which can be moved between a closed position and an open position; and has a plurality of gate leaf elements, which can be tilted with respect to each other around tilt axes which are parallel to each other; a door, which is integrated into the gate leaf and comprises a door leaf, which with respect to the gate leaf elements adjacent to it in the direction of the tilt axes, can be swung around a pivot axis which is essentially perpendicular to the tilt axes; when closed, is accommodated in an opening in the gate leaf; and when closed, is preferably essentially parallel to the plane of the gate leaf; a stabilizing arrangement, which opposes the deformation of the gate leaf. The invention also relates to a safety device for gates of this type.

2. Description of the Related Art

Gates with gate leaves which have a plurality of gate leaf elements able to tilt with respect to each other around parallel tilt axes are used in the form of garage doors and in the form of industrial gates to close off entryways in garages and industrial buildings. In both cases, the gate leaf is usually in a essentially vertical plane when in the closed position, and in an overhead horizontal plane when in the open position. Guide rails are usually used to guide the movement of the gate leaf between the closed position and the open position. These guide rails have vertical sections, which are essentially straight and essentially parallel to the lateral edges of the gate leaf when the gate is closed; the rails also have more-or-less straight, horizontal sections, which are essentially parallel to the edges of the gate leaf when the gate is open; and finally the rails have curved sections, which connect the two straight sections. So that the gate leaf can travel along the curved sections, the gate leaf elements of the gate leaf are connected to each other in such a way that they can tilt with respect to each other around tilt axes which are perpendicular to the guide rails.

When a person wants to leave a room closed off by a gate of this type, the door leaf must be moved in its entirety from the closed position to the open position. In the case of industrial gates, the leaf can be 5 m wide or more. This is associated with a considerable load on the mechanical elements of the gate leaf, and it also takes a significant amount of time. To solve these problems, it has already been proposed that a door be integrated into the gate leaf, this door having a door leaf, which can be pivoted with respect to the adjacent gate leaf elements around a pivot axis which is essentially perpendicular to the tilt axes and which, in the closed position of the gate leaf, extends essentially in a vertical plane. A convenience door of this type makes it possible to leave the room closed by the gate leaf without having to open the entire gate leaf. It is necessary only to open the door leaf integrated into the gate leaf by swinging it around the pivot axis. So that the gate leaf containing the integrated door leaf can be opened, the door leaf of such designs also usually consists of a plurality of door leaf elements, which can tilt with respect to each other around axes which are collinear to the tilt axes.

In these types of designs, it must be guaranteed that, when the gate leaf in which the door leaf is integrated is in the open position, i.e., the position in which the gate leaf is in a essentially horizontal position, it cannot sag in a direction perpendicular to the plane of the gate leaf. In addition, it must be guaranteed during the course of the closing operation that the gate leaf elements located on both sides of the door leaf do not spread apart from each other in the direction of the tilt axes. This problem is especially pronounced in the case of industrial gates in which gate leaf drive devices with traction means at the two lateral edges of the gate leaf are connected to the gate leaf elements which are at the bottom when the gate is closed. In these designs, the action of the traction means on the lateral edges of the gate leaf can promote the tendency of the gate leaf elements located next to the door leaf elements to spread apart in the direction of the tilt axes.

In conventional gates of the type described above, the required stability can be achieved with the help of stabilizing arrangements in the form of box frames, which completely enclose the opening which accommodates the door leaf and which are attached to adjacent gate leaf elements. The frame element forming the bottom edge of the door opening is usually attached to a cutout made in the lower gate leaf element to form the bottom edge. Sufficient stability of the overall construction is achieved in this way with the help of the lower gate leaf element, which extends here over the entire width of the gate leaf, and the lower case element. Nevertheless, the lower gate leaf element and the lower case element attached to it cooperate to form an edge over which it is easy to trip. For this reason, the conventional convenience doors installed in gate leaves are not recognized as escape routes.

To solve this problem associated with the use of conventional convenience doors, a further development of the known gates is proposed in WO 01/055,543, in which the door leaf mounted in the gate leaf extends all the way to the bottom when the gate is closed to avoid the creation of a trip edge. It is claimed that the gate according to the document just cited can be given the stability which the overall construction must have when in the open position and during the closing movement by providing it with a stabilizing arrangement in the form of an arresting device, which opposes the movement of the door leaf relative to the adjacent gate leaf elements when the gate leaf is in the open position. For this purpose, the gate known from the previously mentioned document has at least one thrust pin at the bottom of the door case arrangement or at the bottom of the door leaf. This pin can slide horizontally, parallel to the tilt axes, and, when in the arresting position, engages in an opening in the case or in the door leaf. In addition, the stabilizing arrangement of the known gate designed in the form of the arresting device comprises a locking bar element, which can pivot around an axis parallel to the pivot axis. When the thrust pin slides into the opening, it pushes the locking bar aside. This locking bar element has a latch-like end which grips the edge of an abutment on the door or gate segment and latches itself in place there. This is supposed to prevent the gate leaf elements at the sides of the door leaf from moving apart in the horizontal direction in the main plane of the gate and thus to prevent the previously described formation of a gap between the door leaf and the case or the adjacent gate leaf elements during the opening or closing movement of the gate leaf.

When the gates described in WO 01/055,543 are put into service, however, it has been found that, in spite of the measures described above, the unavoidable play in the movement of the thrust pin and the locking bar element—unavoidable for the sake of ensuring reliable operation—still allows a considerable gap to form between the door leaf and the adjacent gate leaf elements during the opening and closing movement of the gate leaf. In addition, the overall gate leaf, when in the open position, sags to an unacceptable degree in the direction perpendicular to the plane of the gate leaf. In view of these problems, the proposal has already been made that the gates described in WO 01/055,543 be improved by providing the arresting device forming the stabilizing arrangement with at least one arresting element which can move in a plane essentially perpendicular to the tilt axes and preferably essentially parallel to the pivot axis. This elaboration can prevent the previously described gap formation, but a stabilizing arrangement designed in this way is complicated to manufacture.

SUMMARY OF THE INVENTION

In view of the problems of the state of the art described above, it is the object of the present invention to provide a gate of the type indicated above which can be constructed easily, which satisfies the requirements of an escape route, and which at the same time offers satisfactory overall stability.

According to the present invention, this object is met by a further development of the known gates, which is characterized essentially in that the stabilizing arrangement has a threshold element, which, in the closed position of the gate leaf, rests on the floor of the opening closed by the gate leaf, wherein this threshold element forms the bottom edge of the opening which accommodates the door leaf and is preferably attached to the gate elements adjacent to the door opening in the direction of the tilt axes, the height of this threshold element in the direction of the pivot axis being less than 20 mm, preferably less than 10 mm, even more preferably less than 8 mm, and most preferably 5 mm or less, at least in the area of the edges which are preferably essentially parallel to the tilt axes.

The invention is based on the realization that the deformations of the gate leaf observed in the conventional gates of the type described above caused by sagging in a direction perpendicular to the plane of the gate leaf on the one hand and by the spreading-apart of the gate leaf elements adjacent to the opening accommodating the door leaf on the other hand can be prevented by structurally independent elements of the stabilizing arrangement, where only the element of the stabilizing arrangement opposing the sagging of the gate leaf in a direction perpendicular to the plane of the gate leaf must be located in the area of the bottom edge of the door opening, whereas the observed spreading-apart of the gate leaf elements adjacent to the door opening can be prevented by a stabilizing element located above the door opening. In the simplest case, this stabilizing element can be an upper gate leaf element. Sagging in the direction perpendicular to the plane of the gate leaf can be effectively achieved by means of a stabilizing element designed as a threshold element of considerable size and corresponding stability only in the sagging direction. In the direction perpendicular to that, namely, in the direction in which the pivot axis extends, the threshold element can be very thin, because the stabilization in this direction is achieved by the other stabilizing element, possibly located above the door opening. Therefore, the threshold element can be designed with an especially small height of less than 20 mm, preferably of less than 10 mm, even more preferably of less than 8 mm, and most preferably of 5 mm or less in the area of the edges which are parallel to the tilt axes. Because the threshold element is so low, there are no reservations against using the convenience door integrated into the gate leaf of an inventive gate as an escape door.

To obtain a satisfactory stabilizing effect in the direction perpendicular to the plane of the gate leaf, the width of the threshold element in this direction is advisably greater than the thickness of the gate leaf in this direction. To provide better stabilization and also to avoid excessive projection beyond the thickness of the gate leaf, the thickness of the threshold element is advisably more than 150%, preferably more than 200%, even more preferably more than 250%, and especially 300% of the gate leaf thickness or mote, where the threshold element extends preferably over the entire thickness of the gate leaf. With the goal of obtaining a reasonable compromise between stability on the one hand and cost as well as the space requirement on the other, the width of the threshold element is advisably less than 350%, and preferably 300% or less, of the gate leaf thickness.

To obtain the desired stabilizing effect independently of the thickness of the gate leaf, the width of the threshold element can have a value of 60 mm or more, advisably of 80 mm or more, preferably of 100 mm or more, even more preferably of 120 mm or more, and most preferably of 140 mm or more.

To obtain a stabilizing effect opposing the sag in a direction parallel to the pivot axes and to provide simultaneously a receptacle for a sealing element at the bottom edge of the gate leaf, it has been found to be especially favorable for at least one of the edges of the threshold element extending preferably essentially parallel to the tilt axes to be bent back upon itself, i.e., onto the boundary surface which is at the bottom when the gate leaf is closed, to form a receptacle for a sealing element extending in the same direction as that of the tilt axes, the threshold element being formed at least in part out of a material with a tensile strength of more than 120 $N/mm^2$, preferably of more than 370 $N/mm^2$, and even more preferably of more than 540 $N/mm^2$. To obtain a reasonable compromise between stability on the one hand and cost and ease of manufacturing on the other, it has been found advantageous for the threshold element to have a tensile strength of less than 1,000 $N/mm^2$, preferably of less than 900 $N/mm^2$, and even more preferably of less than 750 $N/mm^2$, where a tensile strength range of 540-750 $N/mm^2$ has been found to give especially favorable results.

Alternatively or in addition, the threshold element can have a channel between its lateral edges, which channel is open toward the bottom when the gate is closed and is essentially parallel to the tilt axes, this channel being used to accept a fastening section of the sealing element.

To avoid a trip edge in the area of this preferably essentially centrally located channel formed between the lateral edges of the threshold element, it has been found advisable for the lateral boundary walls of the channel to slope downward ramp-like in the direction toward the lateral edges of the threshold element, where, in the closed position, these slanting walls-preferably enclose an angle of less than 60% with a horizontal plane.

With respect to the goal of avoiding a trip edge, it has been found to be especially advantageous in all embodiments of the invention for the overall height of the threshold element to be less than 22 mm, preferably less than 12 mm, even more preferably less than 10 mm, and most preferably 7 mm or less, even if, in the case of threshold elements with a greater overall height, the formation of a trip edge can still be prevented by the provision of appropriate ramp-like wall elements.

The threshold elements of inventive gates are produced preferably from a material of high tensile strength such as steel with a thickness of 3 mm or less, and preferably of 2 mm or less, which can also be stabilized by additional offsets or bends. Within the scope of the invention, however, it is also possible to use threshold elements of other materials such as composite materials including glass fiber-reinforced plastic and Kevlar, possibly in conjunction with steel. When thicknesses of 3 mm or of less or of 2 mm or less are used, the threshold elements can be produced with a channel to accept a sealing element while still keeping the height of the threshold element relatively low. If a sealing element is not required and/or if the sealing element can be installed underneath the threshold element without the need to form a channel in the threshold element, it would also be possible to imagine the use of threshold elements made of a material with a thickness of 7 mm or less, especially of 6 mm or less, and preferably of 5 mm or less. In this case, a material thickness of approximately 5 mm is especially effective.

As already mentioned above, it has been found advisable, for the purpose of obtaining a tight joint around the gate opening in the closed position of the gate leaf, to install, in the area of the boundary surface of the threshold element located at the bottom when the gate is closed, a sealing element which is essentially parallel to the tilt axes, preferably extending across the entire width of the gate leaf. The sealing element can have a fastening section, preferably at least part of which is accommodated in the channel of the threshold element, and at least one, preferably two or more, sealing flaps, which slant downward in opposite directions from the fastening section. An especially good sealing action is obtained when at least certain sections of at least one edge of at least one sealing flap, i.e., the edge facing away from the fastening section, are bent upward (the "up" direction being based on the closed position of the gate), because this edge is then pushed against the bottom boundary surface of the threshold element when the sealing flap makes contact with the floor of the gate opening to be closed off and thus provides a reliable sealing action between the floor and threshold element. In conjunction with the use of a safety device forming another aspect of the invention, it has been found to be especially advisable for a cable channel to pass through the sealing element, preferably in the area of its fastening section, this channel possibly being open toward the top and extending essentially in the same direction as the tilt axes. A connecting cable between the individual elements of a safety device for the inventive gate can be laid in this cable channel.

When the closed position is reached, the sealing flaps of the sealing element are bent upward with respect to the fastening section. Excessive wear of the sealing element which might be caused by this bending can be prevented by connecting at least one sealing flap to the fastening section by means of at least one predetermined bending site of reduced material thickness.

The desired stabilizing effect can be achieved with especially good reliability by attaching the threshold element to the edges of the gate leaf elements which are at the bottom when the gate is closed, namely, to the edges of the gate leaf elements which are adjacent in the direction of the tilt axes to the door opening. Under consideration of the fact that, under the conditions of mass production, the individual gate leaf elements are all produced in the same way regardless of where they will be ultimately installed, it has been found to be especially favorable to use a fastening element to attach the threshold element, this fastening element being attached on one side to the bottom edge of one of the gate leaf elements and on the other side to an upper boundary surface of the threshold element. A self-substance type of attachment such as adhesive bonding can be used as well as a positive type of attachment such as a screwed joint. A combination of the two types of attachment is preferably used, possibly with additional stabilization by means of a nonpositive type of attachment.

It has already been explained above that the width of the threshold elements of inventive gates is preferably greater than the thickness of the gate leaf in a direction perpendicular to the plane of the gate leaf. In the corresponding embodiments of the invention, measures must be taken to prevent a person from standing on the threshold element when the gate leaf is in the closed position, because he could be pulled upward along with the gate leaf when the gate is opened. For this purpose, it has been found to be especially favorable for the fastening element to have an upper boundary surface section which, when the gate is closed, proceeds from the outside surface of the gate leaf and slants downward toward an external edge of the threshold element and/or an upper boundary surface section which, when the gate is closed, proceeds from the inside surface of the gate leaf and slants downward toward an internal edge of the threshold element, where at least one of the upper boundary surface sections, when in the closed position, forms an angle of 10° or more, preferably of 150 of more, and even more preferably of 20° or more, with a horizontal plane. In this embodiment of inventive fastening elements, the goal is achieved that a foot which may step on an upper boundary surface section will slide off this boundary section and not find any safe surface to stand on, which means that there is no risk that a person might be able to stand on the fastening element or on the threshold element and be pulled upward when the gate leaf is opened.

Conventional cross-sectional shapes of gate leaf elements which are able to offer both the required stability and sufficient protection for the fingers are described in, for example, EP 304 642 and EP 370 376. The disclosure content of these documents with respect to the cross-sectional shapes of conventional gate leaf elements or panels in a cross-sectional plane perpendicular to the tilt axes is herewith included by explicit reference in this specification. In these conventional gate leaf elements, a recess is provided in the area of the bottom edge of the gate leaf elements, and a projection located in the area of the upper edge of an adjacent panel can engage in this recess. In terms of the stabilizing effect desired within the scope of the present invention, it has also been found favorable for the fastening element to have a projection which fits into a recess in the bottom edge of the gate leaf element, this recess being parallel to the tilt axes and open toward the bottom. Additional stabilization can be obtained by providing the fastening element with a receptacle between a wall element resting against an inner surface of the gate leaf and the projection, this receptacle being designed to receive a projection located on the bottom edge of the gate leaf element.

As already explained above, the door leaf of the inventive gate advisably also has a plurality of door leaf elements, which are able to tilt with respect to each other around axes which are collinear to the tilt axes.

In terms of production technology it has proven to be especially advisable for the door leaf elements to have approximately the same shape in a cross-sectional plane perpendicular to the tilt axes as the gate leaf elements. In this case, a gap corresponding to the height of the fastening element is usually left open between the bottom edge of the door leaf and the threshold element. Good closure in the area of the bottom edge of the door leaf can then be obtained by installing a transition element on the door leaf element which is at the bottom when the gate leaf element is closed, which transition element is located between the threshold element and the bottom door leaf element when the door leaf is closed. The transition element can have a sealing arrangement which, when the door leaf is closed, rests against the threshold element, which is attached to the adjacent gate leaf elements. To provide a reliable sealing function, a sealing arrangement of this type advisably comprises a sealing element which, when the door leaf is closed, rests against a forward boundary surface of the threshold element and/or a sealing element which, when the door leaf is in the closed position, rests against an upper boundary surface of the threshold element.

To provide the inventive gate with an attractive external appearance and also to minimize the previously described risk associated with stepping on the threshold element, it has been found to be especially helpful for the shape of the transition element in a cross-sectional plane perpendicular to the tilt axes to have approximately the same shape as the fastening element at least in the area of the external surface of the gate leaf; that is, it is advisable for the transition element to have an upper boundary surface section which slants down toward the outside edge of the threshold element. It is also possible to provide the transition element with an upper boundary surface section which slants down toward the inside edge of the threshold element. Alternatively or in addition, the colors of the transition element and of the fastening element can be coordinated with each other. Their colors are preferably the same, and even more preferably they are both black in accordance with the color of conventional sealing arrangements. The transition element also advisably has a projection, which fits into a recess in the bottom edge of the bottom door leaf element.

As already explained above in detail, the threshold element of an inventive gate opposes the sag of the gate leaf in a plane perpendicular to the plane of the gate leaf. The sag of the gate leaf in a direction parallel to the pivot axis can be opposed by a stabilizing element which is located above the door leaf opening and which extends all the way across this opening. In an especially simple embodiment of the invention, the stabilizing element can be realized by a continuous gate leaf element above the door leaf opening. So that it can offer the desired stabilizing action, the stabilizing element advisably has a boundary surface which, in an especially preferred embodiment of the invention, is formed by an essentially flat layer of a material of high tensile strength. This boundary surface is located in a essentially vertical plane when the gate leaf is in the closed position.

If the gate leaf element which is at the top when the gate is closed has a cutout to form the upper edge of the door leaf opening, this uppermost gate leaf element cannot provide a sufficient stabilizing effect. It has been found advantageous in such cases to install an additional stabilizing element in the gate leaf element located above the door opening and/or to fasten it to an inner boundary surface of the gate leaf element located above the door opening. This additional stabilizing element can be in the form of a channel open toward gate leaf element, the bottom of the channel extending essentially in a vertical plane when the gate is closed. The channel is provided with flanges, which are bent outward from the channel walls, so that this additional stabilizing element can be attached conveniently to the inner boundary surface of the gate leaf element.

In the case of gates which can be moved between the open position and the closed position by means of an electric drive unit, it must be ensured that the electric drive will be turned off automatically if the leading edge of the closing gate leaf strikes an object or a person during the course of the closing movement. Conventional gates have for this purpose a force limiter on the drive to shut off the motor automatically when a predetermined drive force is exceeded. Because of the time lag involved in controlling the movement of the gate leaf, however, there is a certain delay before the gate leaf actually stops moving. The distance traveled during this delay is absorbed in the case of conventional gates by the sealing arrangement located on the bottom edge of the gate leaf. In inventive gates, however, very thin sealing arrangements can be used, and a section of the threshold element at the bottom edge of the gate leaf not protected by a sealing element can strike an object or person during the course of the closing movement. In this case, in spite of the known force-limiting function, considerable material damage or personal injury can still occur.

In the case of a gate with a gate leaf which can move between a closed position and an open position and which has a plurality of gate leaf elements which can tilt with respect to each other around parallel tilt axes, this risk can be excluded according to another aspect of the invention by providing a safety device which operates in a contactless manner to detect objects or persons in the area of the path of movement of the edge of the gate leaf which is in the leading position during the closing movement.

With a safety device of this type, the path traversed by the leading edge of the gate leaf during the closing movement is already being monitored without contact before this leading edge reaches the section of the path in question. Thus the drive unit can be shut off before the gate leaf strikes an object or person in the path of movement. A safety device of this type can be used not only in inventive gates with integrated convenience doors but also in conventional gates without convenience doors. It is especially useful, however, to use these types of safety devices in inventive gates with integrated convenience doors and with a sealing arrangement of reduced thickness located at the bottom boundary surface of the threshold element.

The safety device of the inventive gates advisably has at least one transmitter arrangement to send wireless signals in a direction essentially parallel to the tilt axes and at least one receiver arrangement to receive the signals sent by the transmitter arrangement, where the transmitter arrangement and the receiver arrangement are installed advisably in the area of opposite lateral edges of the gate leaf, preferably on the gate leaf itself. The signals of the transmitter arrangement are advisably emitted parallel to and, with respect to the direction of the closing movement, upstream of the edge of the gate leaf which is in the leading position during the closing movement, so that objects and persons can be detected before the edge of the gate leaf strikes them during the course of the closing movement.

For use in conjunction with inventive gates in which the width of the threshold element in a direction perpendicular to the plane of the gate leaf in the closed position is greater than the thickness of the gate leaf, it has been found to be effective, as a means of obtaining an especially reliable safety function, for the signal-transmitting arrangement to be operated along two or more signal paths which are offset from each other in a direction perpendicular to the plane of the gate leaf and which are preferably essentially parallel to the tilt axes. With transmitter arrangements such as this, it is possible to create a signal grid in the space through which the threshold passes, this grid moving along with the threshold element, where the interruption of only one of the grid elements formed by the individual signal paths during the course of the movement of the gate leaf can be used to generate a shut-off signal for the gate drive unit.

With respect to the generation of suitable signal grids, it has been found to be especially advisable for cost reasons for a common transmitter element to feed at least two signal paths. This can be made possible by the use of suitable deflector elements in the area of the opposite edges of the gate leaf. To obtain an especially reliable safety function, it has been found advisable for the transmitter arrangement to have at least two transmitter elements, each of which is designed to feed at least one signal path. With respect to the two embodiments just described, it has been found to be favorable for cost reasons for a common receiver element of the receiver arrangement to be assigned to at least two signal paths.

When gates of the inventive type are mass-produced, the accuracy with which the transmitter arrangements and receiver arrangements are manufactured and installed will not always be very high. In addition, the during course of the movement of the gate leaf, especially in the case of gate leaves with integrated convenience doors, it can be anticipated that the gate leaf will undergo a certain slight amount of deformation. Under these boundary conditions, it is still possible to ensure the reliable operation of the safety device of an inventive gate by designing the signal-transmitting arrangement to emit the signals in the form of a cone with a beam angle of more than 2°, preferably of 5° or more. To avoid the need for excessive transmitting power while guaranteeing reliable signal reception at the same time, the signal cone should have a beam angle of 20° or less, especially of 10° or less, and most preferably of 8° or less.

As already explained above, during the closing movement, the gate leaf and thus also the edge of the gate leaf which leads during the closing movement pass through an arc-shaped section of the predefined path between a vertical guide rail section and a horizontal guide rail section. Especially in the case of garage doors with an overall height of 2.50 m, it is also necessary to reliably prevent the gate leaf edge which leads during the closing movement from striking objects or persons in the area of this arc-shaped section of the predefined path. In this context it has been found to be especially advantageous for at least one element of the transmitter arrangement such as a transmitter element realized in the form of a light source or, for example, a deflector element realized in the form of a mirror and/or at least one element of the receiver arrangement such as receiver element realized in the form of a photodiode or a deflector element realized in the form of a mirror to be attached by way of a connecting arrangement to the gate leaf so that it can pivot around an axis essentially parallel to the tilt axes. In this way, it can be achieved that, when the pivotably mounted transmitter element and/or receiver element travels through the arc-shaped section of the predefined path, it will pivot with respect to the leading of the gate leaf and will thus remain approximately in the same vertical plane as this leading edge during all phases of the closing movement. In this context, it has also been found to be especially advisable to provide a stop arrangement to limit the pivoting movement of the element of the transmitter arrangement and/or of the element of the receiver arrangement, so that, at least along a certain section of the path of the edge of the gate leaf which leads during the closing movement, the pivotably mounted element will be located underneath this edge and approximately in a vertical plane containing the leading edge during the closing movement.

For safety reasons, it has been found advisable for the connecting arrangement and thus also the element of the receiver arrangement and/or of the transmitter arrangement attached to it to be attached to an inner boundary surface of the gate leaf, so that, when the gate leaf is closed, it is impossible to gain access from the outside to the connecting arrangement or to the elements attached to it. In this preferred embodiment of the invention, the desired arrangement of the element of the receiver arrangement and/or of the transmitter arrangement attached to the connecting arrangement in a vertical plane with the edge of the gate leaf which leads during the closing movement can be achieved by providing the connecting arrangement with a connecting lever, which is attached pivotably to the gate leaf, especially to an inner boundary surface of the gate leaf, in the area of the edge which leads during the closing movement, which lever pivots around a pivot axis which is parallel to the tilt axes and which extends, at least in one pivot position, across the edge of the gate leaf which leads during the closing movement. For this purpose, the connecting lever can have two or more essentially straight lever segments, which enclose an angle of less than 180° with each other in a plane perpendicular to the tilt axes.

As already explained above, the pivoting movement of the connecting arrangement can be limited by means of a suitable stop arrangement in such a way that the connecting arrangement is not pivoted too far away from the edge which leads during the closing movement of the gate leaf, which means that the element of the transmitter arrangement and/or of the receiver arrangement attached to the connecting arrangement will always be located approximately in a vertical plane with the edge of the gate leaf which leads during the closing movement, even in the area of the arc-shaped section of the predefined path. This limitation of the pivoting movement of the connecting arrangement, however, means that the connecting arrangement has only a limited ability to give way when it strikes the floor of the space closed off by the gate leaf or when it strikes an object or part of a person in contact with the floor. This can lead to damage to the connecting arrangement and to the object lying on the floor and/or can cause injury to the person. This risk can be reduced by connecting at least two lever segments of the connecting lever pivotably to each other with respect to a pivot axis parallel to the tilt axes, where preferably the pivoting movement of the lever segments is limited by another stop arrangement. In the course of the pivoting movement of the lever segments, these segments move toward each other. During the final phase of the closing movement of the gate leaf, therefore, the connecting arrangement folds together in the direction opposite the direction of movement, which means that the limitation of the pivoting movement by the stop arrangement does not interfere with the trouble-free operation of a gate equipped with an inventive safety device and also that damage to objects on the floor of the opening to be closed and/or injury to persons can be reliably prevented.

Damage to transmitter elements, deflector elements, and receiver elements of the safety device of inventive gates can be avoided in an especially simple manner by providing the connecting lever pivotably mounted on the gate leaf with a housing designed to hold at least one transmitter element, at least one receiver element, and/or at least one deflector element. Such a housing protects the elements cited above from damage without impairing their functionality. So that the space through which the threshold element passes can be monitored in the desired manner, it has been found to be especially favorable for the housing to be located on the lever segment attached pivotably to the lever segment attached to the gate leaf. To ensure functionality when signal grids with two or more signals propagating along parallel signal paths are used, it has been found advisable for the housing to have two or more windows, at least one window being provided for each signal being propagated along one of the signal paths.

An especially compact design of the safety device for inventive gates is obtained when the end of the lever segment attached pivotably to the lever segment attached to the gate leaf, i.e., the end of the segment facing away from the pivot axis, is offset from the lever segment attached to the gate leaf in the direction of the tilt axis. As a result of this arrangement, the offset lever segment can be accommodated next to the gate leaf when the gate leaf is in the closed position.

As already explained above, an element of the safety device attached to the connecting arrangement is advisably pivoted automatically into the interior of the space closed by the gate leaf when the gate leaf reaches the closed position. The connecting arrangement is advisably designed to escape in a direction opposite the closing direction when it strikes an obstacle during the final phase of the closing movement.

An inventive safety device for an inventive gate is characterized by a transmitter element and/or a receiver element and by a connecting arrangement designed to connect this element in a pivoting manner to the gate leaf, where the transmitter element can have a light source, the receiver element can have a photodiode, and the connecting arrangement can have a connecting lever with two or more lever segments, possibly hinged to each other.

The various features of novelty which characterize the invention are pointed out with particularity in the claims annexed to and forming a part of the disclosure. For a better understanding of the invention, its operating advantages specific objects attained by its use, reference should be had to the drawing and descriptive matter in which there are illustrated and described preferred embodiments of the invention.

DESCRIPTION OF THE PREFERRED EMBODIMENTS

Figure 1:
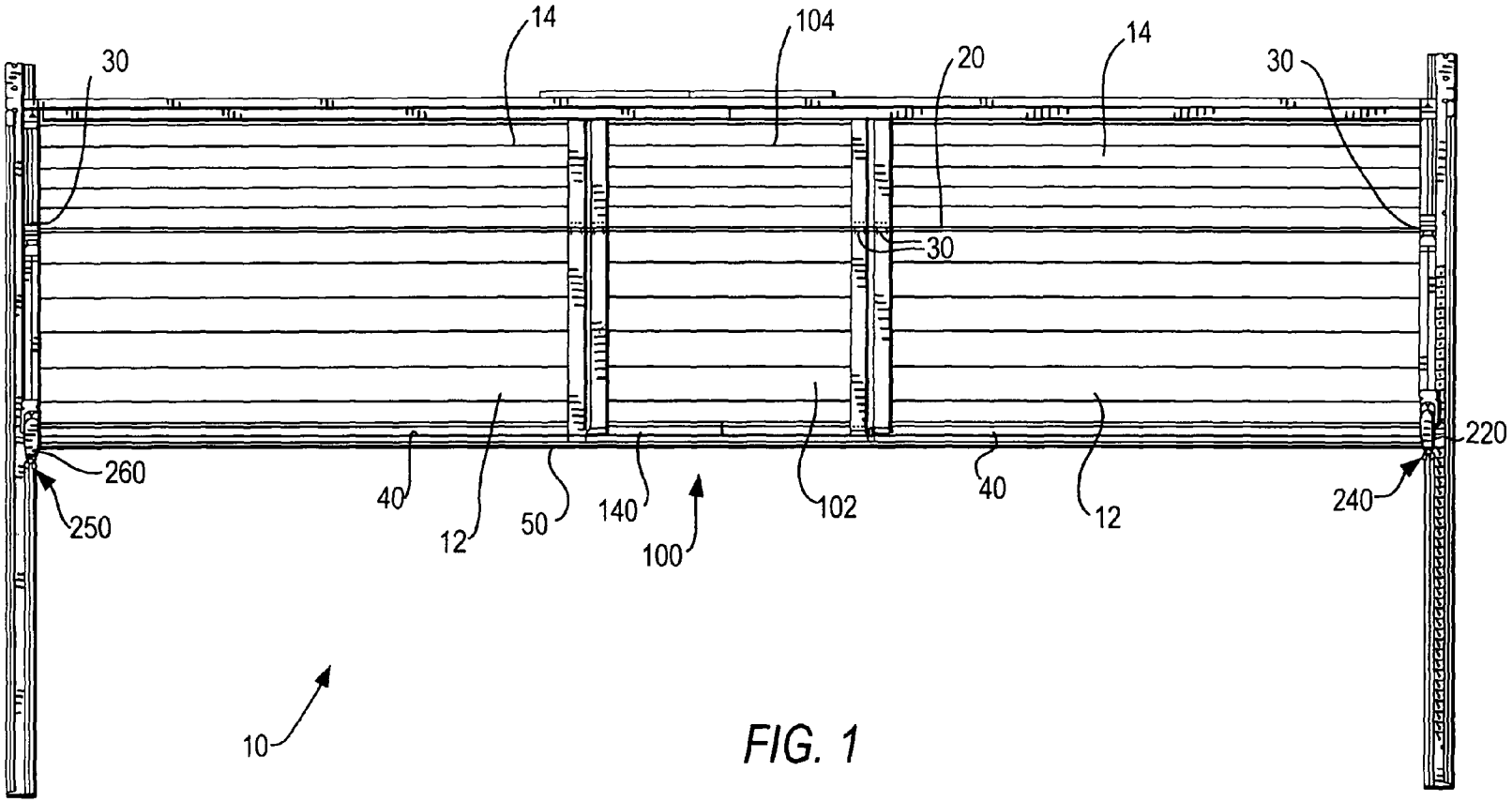
FIG. 1 shows a view, from the inside, of an inventive gate between the open position and the closed position.

The gate leaf designated overall by the number 10 in FIG. 1 comprises a plurality of gate leaf elements; of these, the gate leaf elements 12 and 14, which are at the bottom when the gate is closed, are arranged one above the other in the position shown in FIG. 1. A door leaf with two door leaf elements 102 and 104, also arranged one above the other in FIG. 1, is integrated into the gate leaf and is designated overall by the number 100. The gate leaf elements 12 and 14 as well as the door leaf elements 102 and 104 can be tilted with respect to each other around tilt axes 20 by means of hinge-like joints indicated at 30.

The bottom edge of the opening in the gate leaf 10 which holds the door leaf 100 is bounded by a threshold element 50, which is attached to the bottom edge of the gate leaf elements 12 located on the two opposite sides of the door opening. In the embodiment of the invention shown in FIG. 1, the threshold element 50 is attached to the gate leaf elements 12 by means of fastening elements 40, which are attached on one side to the upper boundary surface of the threshold element 50 and on the other side to the lower boundary surface of the gate leaf element 12. In the embodiment of the invention shown in FIG. 1, the gap left between the bottom edge of the door leaf element 102 and the threshold element 50 is bridged by a transition element 140.

Figure 2:
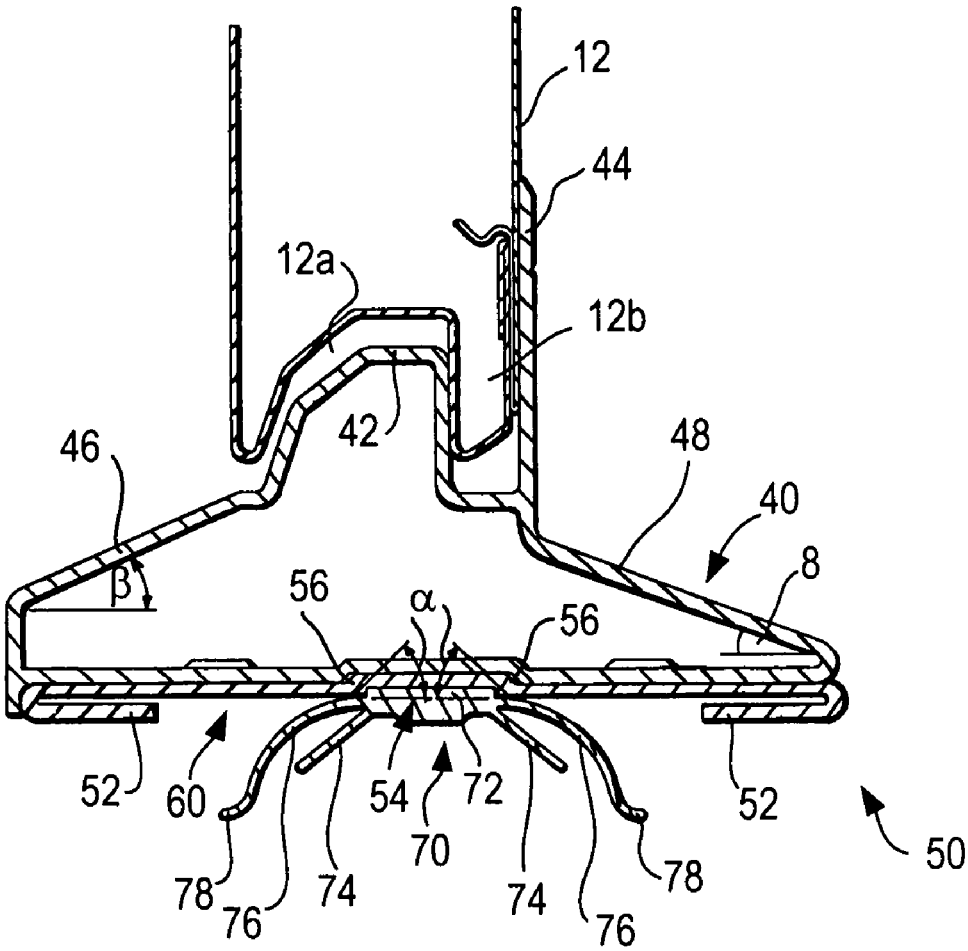
FIG. 2 shows a cross-sectional view of the bottom edge of the gate leaf elements in a cross-sectional plane perpendicular to the tilt axes.

As can be seen in FIG. 2, the width B of the threshold element 50 in a direction perpendicular to the plane of the gate leaf is greater than the thickness D of the gate leaf in this direction. In the embodiment of the invention shown in the drawing, the width B of the threshold element is 123.5 mm, whereas the thickness D of the gate leaf element is 42 mm. Within the scope of the invention, however, it is also possible to use threshold elements of greater or lesser width and to use gate leaves of lesser or greater thickness. In the embodiment of the invention shown in FIG. 2, the threshold element extends over the entire thickness of the gate leaf and thus projects beyond the gate leaf on both the inside and on the outside of the gate leaf.

The edges 52 of the threshold element 50 which are parallel to the tilt axes 20 are folded back on themselves to produce a greater stabilizing effect and to form a receptacle 60 for the sealing element 70, which is mounted on the lower boundary surface of the threshold element 50.

The sealing element 70 comprises a fastening section 72 and a total of four sealing flaps 74 and 76, where the outer sealing flaps 76 and the inner sealing flaps 74 slant downward in opposite directions. The edges 78 of the sealing flaps 76 facing away from the fastening section 72 are bent outward and upward to provide a better sealing action upon contact with the floor of the room to be closed off. The fastening section 72 of the sealing element 70, which extends parallel to the tilt axes over the entire width of the gate leaf, is located in a channel 54 in the threshold element 50, which channel is open toward the bottom, is located centrally between the edges 52, and is parallel to the tilt axes over the entire width of the gate leaf. The lateral boundary walls 56 of the channel 54 descend ramp-like toward the lateral edges 52 of the threshold element 50, where, in the embodiment of the invention shown in the drawing, they form an angle $\alpha$ of approximately 45° with a horizontal plane. In the area of the lateral edges 52, the height h of the threshold element 50 of the embodiment of the invention shown in the drawing is approximately 5 mm. The overall height H in the area of the channel 54 in the embodiment of the invention shown in the drawing is approximately 7 mm. The depth T of the receptacle 60 is approximately 3 mm.

The threshold element 50 of the embodiment of the invention shown in FIG. 2 is produced in its entirety out of steel sheet with a thickness of approximately 2 mm. As can be seen in FIG. 1, the threshold element extends over the entire width of the gate leaf element.

Figure 4A:
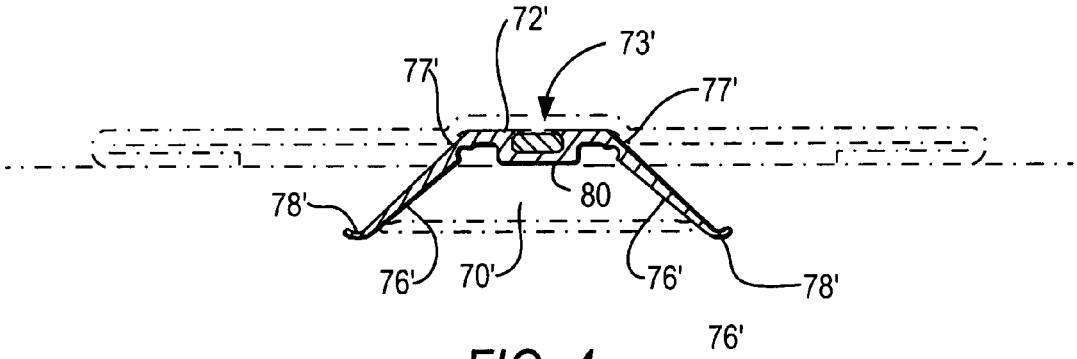
FIG. 4 shows a cross-sectional view of a sealing element attached to the bottom boundary surface of the threshold element of an inventive gate in a cross-sectional plane perpendicular to the tilt axes.
Figure 4B:
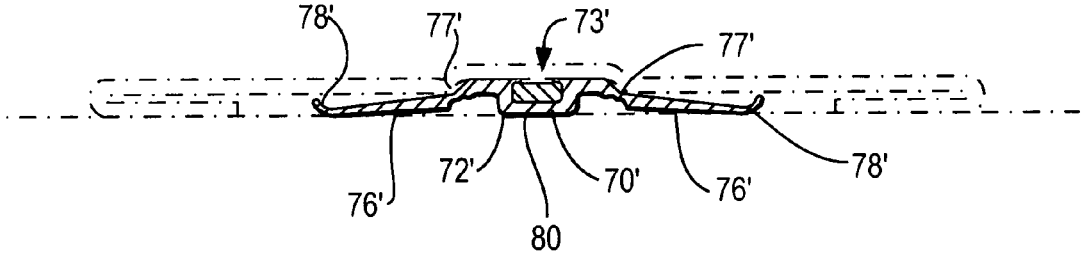

FIG. 4 shows a sealing element 70', which can be used as an alternative or as an addition to the sealing element 70; this alternative sealing element has a central fastening section 72' and two sealing flaps 76', which slant downward from the central section in opposite directions, each of which is bent upward at the edge 78' facing away from the fastening section 72'. The sealing flaps 76' are connected to the fastening section 72' by predetermined bending points 77' of reduced material thickness. A channel 73', which is open toward the top and in which a cable 80 can be accommodated, passes through the fastening section 72'.

According to FIGS. 1 and 2, the threshold element 50 is attached to the gate leaf element 12 by means of a fastening element 40, which is attached on one side to the upper boundary surface of the threshold element 50 and on the other side to the bottom edge of the gate leaf element 12. To obtain the desired stabilizing effect, a projection 42 on the top edge of the fastening element 40 fits into a recess 12*a* in the bottom edge of the gate leaf element 12. A projection 12*b*, which projects downward in the area of the inside surface of the gate leaf from the bottom edge of the gate leaf element 12, fits into a receptacle, which is formed between a wall element 44 resting against an inside surface of the gate leaf element 12 and the projection 42. According to FIG. 2, the fastening element 42 has an upper boundary surface section 46, which begins at the outside surface of the gate and, when the gate is closed, slants downward toward the outer edge of the threshold element 50, and an upper boundary surface section 48, which begins at the surface of the gate leaf which is on the inside when the gate is closed and slants downward toward the inner edge of the threshold element 50. When the gate is closed, the upper boundary surface section 46 forms an angle β of approximately 25° with a horizontal plane. The upper boundary surface section 48, when the gate is closed, forms an angle γ of approximately 20° with a horizontal plane. Because of the downward-slanting upper boundary surface sections 46 and 48, a foot placed on the fastening element 40 will slide off the fastening element. The danger that a person standing on the fastening element 40 could by accident be carried along by the gate leaf 10 when it opens is thus reduced.

Figure 3:
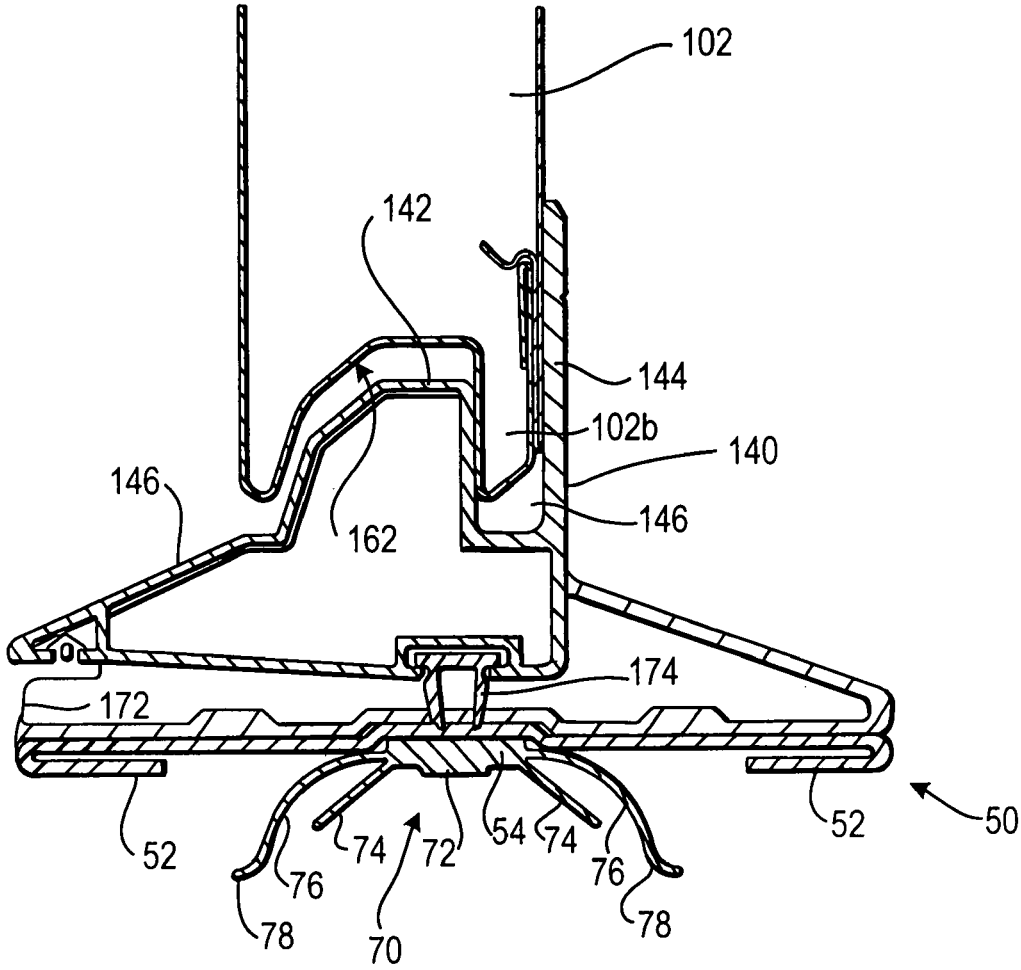
FIG. 3 shows a cross-sectional view through the bottom edge of a door leaf element in a cross-sectional plane perpendicular to the tilt axes.

According to FIG. 3, the bottom door leaf element 102, in a cross-sectional plane perpendicular to the tilt axes, has approximately the same shape as the bottom gate leaf element 12. The gap between the bottom edge of the door leaf element 102 and the threshold element 50 is bridged by a transition element 140, the cross-sectional form of which, starting from the inner boundary surface of the door leaf element 102 in the direction toward the outer edge of the threshold element 50, is approximately the same as the cross-sectional form of the fastening element 40. Accordingly, the transition element 140 has a projection 142 on its upper edge, which projection fits into a recess 102*a* in the bottom edge of the door leaf element 102. In addition, a receptacle 146 is formed between a wall element 144 resting against an inner boundary surface of the door leaf element 102 and the projection 142, in which receptacle a downward-slanting projection 102*b* in the area of the inner boundary surface of the door leaf element 102 is received. Like the fastening element 40, the transition element 140 also has an upper boundary surface section 148, which slants downward toward the outer edge of the threshold element 50. So that the door leaf can execute the desired opening movement, the transition element 140 is not attached to the threshold element 50. To ensure the desired seal in the closed position of the door leaf, two sealing elements 172 and 174 are located in the area of the lower boundary surface of the transition element 144. When the door leaf is closed, the sealing element 172 rests against a forward boundary surface of the threshold element 50, whereas the sealing element 174 rests against the upper boundary surface of the threshold element formed by the channel 54.

The door leaf element 102, like the gate leaf element 12, is produced in the form of a twin-shell panel and is at least partially filled with insulating material such as polyurethane foam. The two shell elements are positively connected to each other at their folded-back edge sections. In the same way that the fastening element 40 is attached to the gate leaf element 12 in the area of these folded-back edge sections of the panel shells, the transition element 144 is attached to the door leaf element 102 by means of screws (not shown). So that the position of the fastening element 40 and of the transition element 140 can be adapted to any uneven floor areas which may be present, the attachment is carried out with the help of slots in the wall elements 44 and 144, where the slots can be essentially parallel to the pivot axis and perpendicular to the tilt axes.

Figure 5:
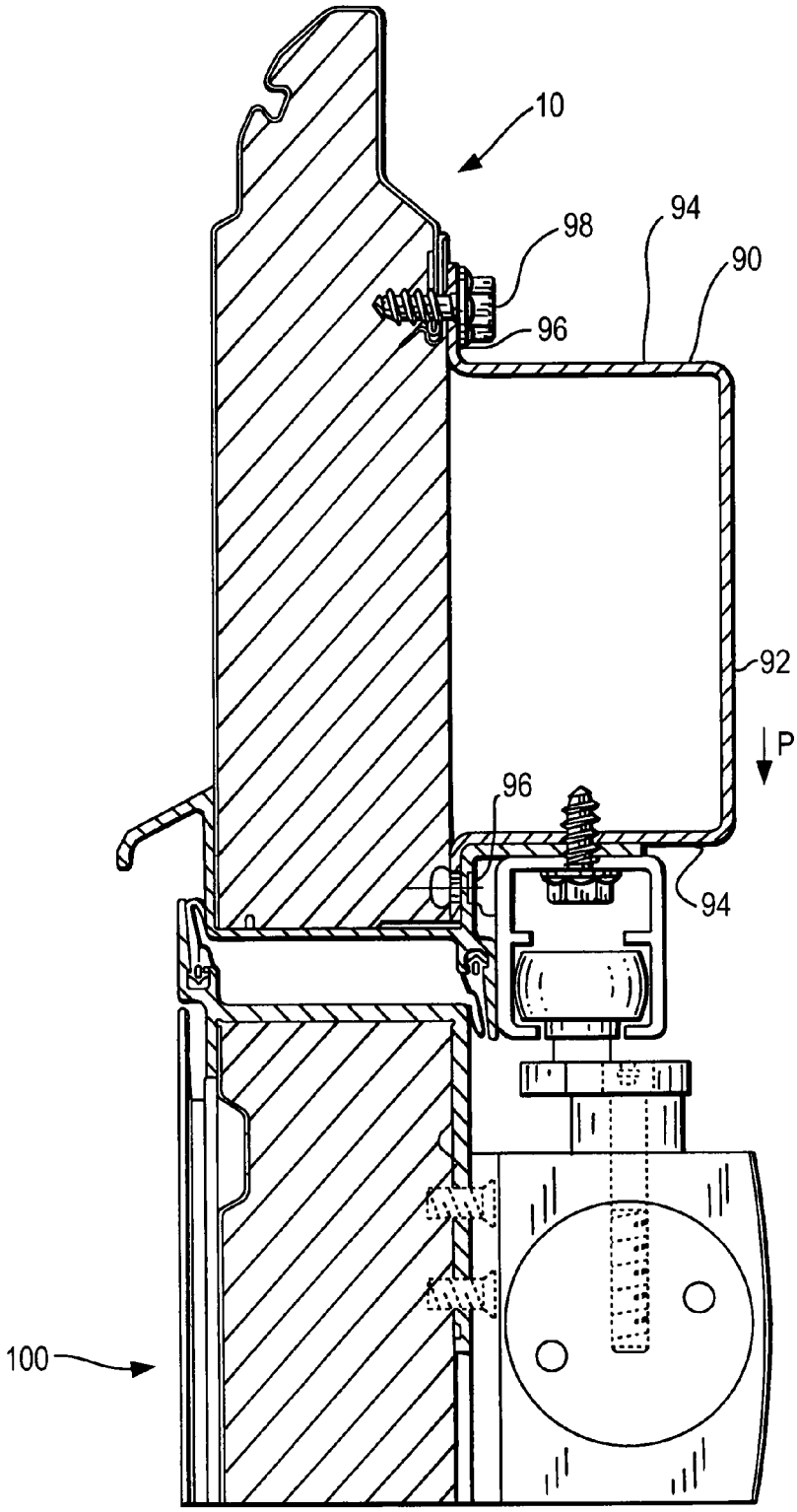
FIG. 5 shows a cross-sectional view of the top edge of an inventive gate leaf in a cross-sectional plane perpendicular to the tilt-axes.

According to FIG. 5, the stabilizing arrangement of an inventive gate can also have at least one stabilizing element 90, which is located above the opening accommodating the door leaf 100 and extends all the way across it. In the embodiment of the invention shown in FIG. 5, this stabilizing element is formed out of steel sheet with a material thickness of approximately 2 mm and is designed in the form of a channel which is open toward the inner boundary surface of the gate leaf 10. When the gate leaf 10 is closed, the bottom 92 of the channel is located in a essentially vertical plane. The channel walls 94 are essentially perpendicular to the channel bottom 92. At the edges facing away from the channel bottom 92, the channel walls 94 are bent outward to form fastening flanges 96. Screws 98 pass through the flanges 96 and can be screwed into the gate leaf element in the area of the bent-back edge sections of the shells of the upper gate leaf element. As a result of the channel bottom 92 and the flange-like fastening sections 96, the stabilizing element 90 acquires a very high overall resistance to sagging in the direction of the force of gravity indicated by the arrow P in FIG. 5. In the illustrated embodiment of the invention, the stabilizing element 90 is attached to the inner boundary surface of the gate leaf 10. In this embodiment, the top edge of the opening in the gate leaf serving to hold the door leaf is formed by a cutout in the uppermost gate leaf element. If a complete gate leaf element extends continuously across the entire width of the gate leaf above the door leaf opening, this complete gate leaf element can serve as a supplemental stabilizing element. In addition, in an embodiment of the type described in connection with FIG. 5, it is also possible for the supplemental stabilizing element 90 to be integrated into the gate leaf element in order thus to avoid any inward-projecting parts.

The embodiment of the invention shown in FIG. 1 comprises a contactless safety device with a transmitter arrangement 210, which is located in the area of the right edge of the gate leaf, underneath the bottom edge of the gate leaf which is in the leading position during a closing movement, and a receiver arrangement 250, which is located in the area of the left edge of the gate leaf underneath the bottom edge which is in the leading position during the closing movement. The transmitter arrangement 210 can have a light source, and the receiver arrangement 250 can have a photodiode. In the embodiment of the invention shown in FIG. 1, the transmitter arrangement 210 is connected to the bottom edge of the gate leaf element 12 by a connecting arrangement 220, whereas the receiver arrangement 250 is connected to a bottom edge of the gate leaf element 12 by a connecting arrangement 260. In other embodiments of the invention, it is also possible simply to connect a deflector arrangement by means of appropriate connecting arrangements to the gate leaf elements 12 and to work with transmitter elements and receiver elements such as light sources and photodiodes which are mounted in stationary positions. When light sources are used as transmitter elements, the deflector arrangements can be realized in the form of simple mirrors. In any case, when an inventive safety device is used, a signal, possibly also an acoustic signal, which propagates underneath the leading edge of the closing gate leaf, is generated. This signal is received by the receiver arrangement 250 and can be used to control the drive unit. The transmitter arrangement 210 according to FIG. 1 can be operated to emit signals in a signal cone with a beam angle of more than 2°. This guarantees that the receiver arrangement 250 can receive signals emitted by the transmitter arrangement 210 even if the gate leaf is twisted, as long as there is no obstacle present which could block the signal.

The transmitter element 210 and the receiver element 250 are attached pivotably to the gate leaf 10 by means of the connecting arrangements 220 and 260 in such a way that they can pivot around an axis which is essentially parallel to the tilt axes 20. The connecting arrangements which can be used for this purpose are described below on the basis of the connecting arrangement 220 shown in FIG. 6. The connecting arrangement 220 is designed in the form of a connecting lever, comprising the three segments 222, 224, and 226. The connecting lever 220 is attached to the bottom edge of the gate leaf 10 so that the entire lever can pivot around a pivot axis 230, which is parallel to the tilt axes 20. The lever segment 222 adjacent to the gate leaf 10 is assigned a stop 231, by means of which a pivoting movement of the lever segment 222 in the pivoting direction indicated by the arrow S away from the bottom edge of the gate leaf 10 is limited. The lever segment 222 forms an obtuse angle $\alpha$ of approximately 130° with the adjacent lever segment 224. The lever segments 222 and 224 form a single unit. The lever segment 226 is connected to the end of the lever segment 224 facing away from the lever segment 222 so that it can pivot around a pivot axis 232 parallel to the tilt axes 20. The pivoting movement of the lever segment 226 with respect to the lever segment 224 is limited by a stop 234. In the embodiment of the invention shown in FIG. 6, the maximum pivot angle $\alpha'$ of the lever segments 226 with respect to the lever segment 224 is 110°.

Figure 6:
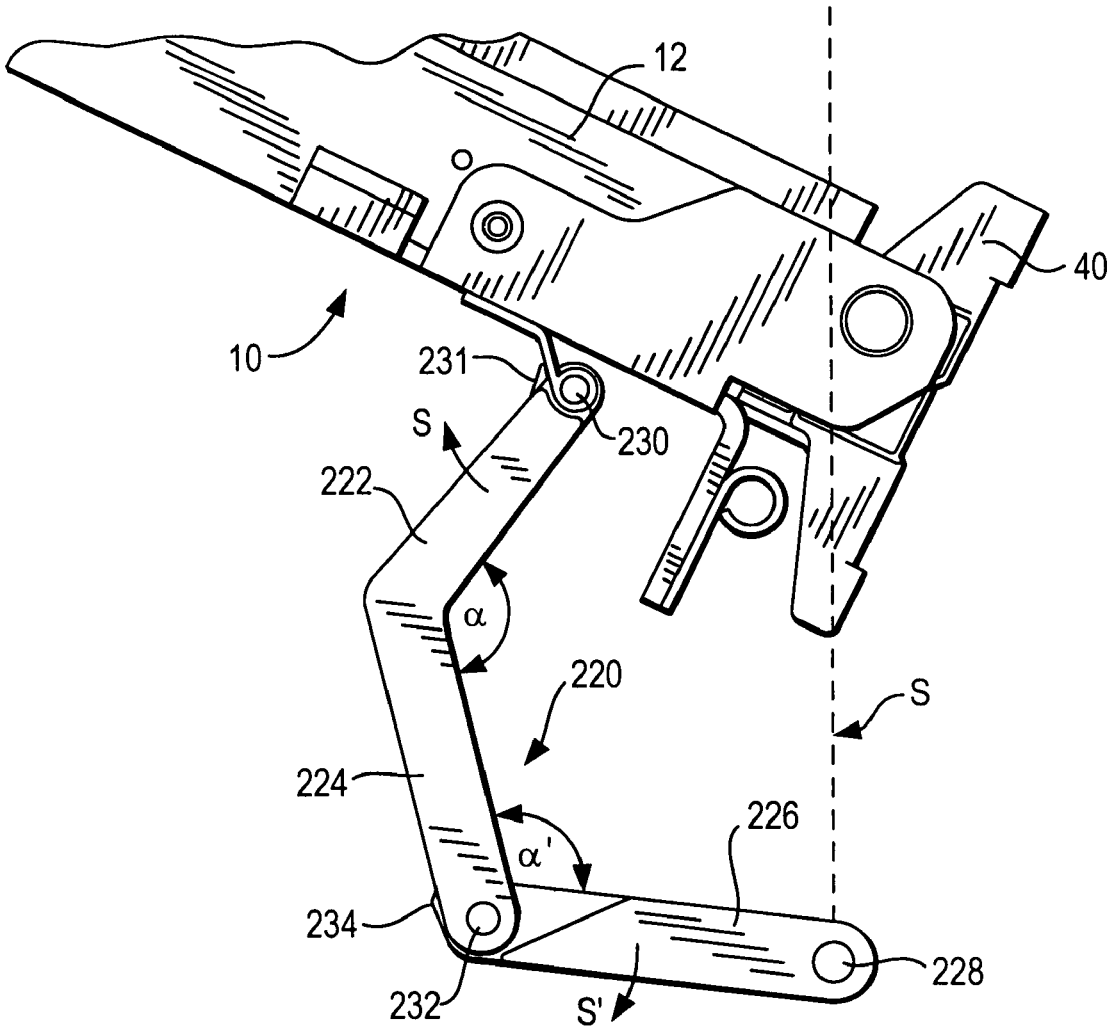
FIG. 6 shows a view of the connecting arrangement of an inventive safety device at the beginning of the closing movement of gate leaf.

In the position of the gate leaf 10 close to the opening position as shown in FIG. 6, where the gate leaf element 12 is almost in a horizontal plane, the hinged connection of the connecting arrangement 220 to the gate leaf 10 means that the hole in the end of the lever segment 226 facing away from the lever segment 224, i.e., the hole serving to hold the transmitter element 210, is approximately in a vertical plane S with the edge of the connecting element 40 which is at the bottom in this position. As a result of the stop arrangement 234, the pivoting movement of the lever segment 226 with respect to the lever segment 224 is limited in the direction indicated by the arrow S'. In the course of the closing movement of the gate leaf, the connecting arrangement 220, starting from the position shown in FIG. 6, arrives in the position shown in FIG. 7, in which the lower gate leaf 12 is already in a vertical plane. To reach the position shown in FIG. 7, the connecting arrangement 220 swings around the pivot axis 230 under the effect of gravity. The pivoting movement in the direction designated by the arrow S" is limited by another stop element 236, so that the hole 228 serving to hold the transmitter element 210 is still located in a essentially vertical plane with the bottom edge of the gate leaf element 12 in the position shown in FIG. 7. By the time the fully closed position is reached, the connecting arrangement has arrived in the position shown in FIG. 8. The lever segment 222 has been pivoted in the direction indicated by the arrow S in FIG. 6, whereas the lever segment 226 has pivoted around the lever segment 224 in the direction opposite that indicated by the arrow S', i.e., toward the lever segment 224. As a result of the two pivoting movements just described, the connecting arrangement can move out of the way of objects or parts of the body in contact with the floor.

Figure 9A:
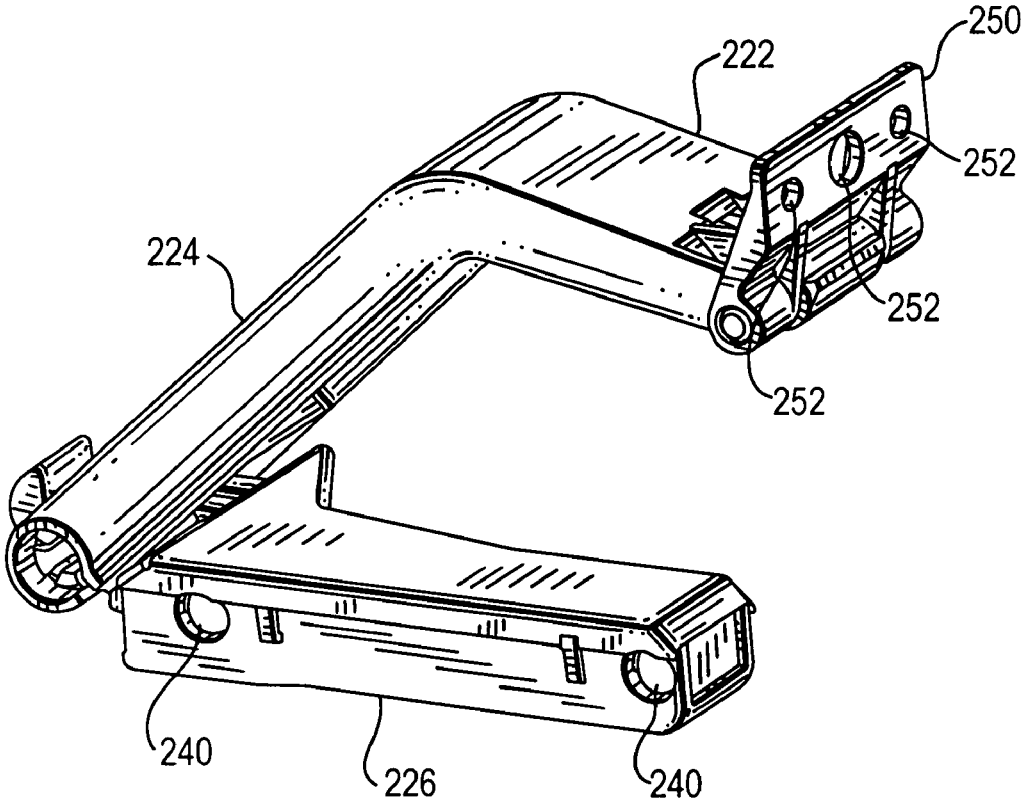
FIG. 9 shows a connecting arrangement of an inventive safety device according to another embodiment of the invention.
Figure 9B:
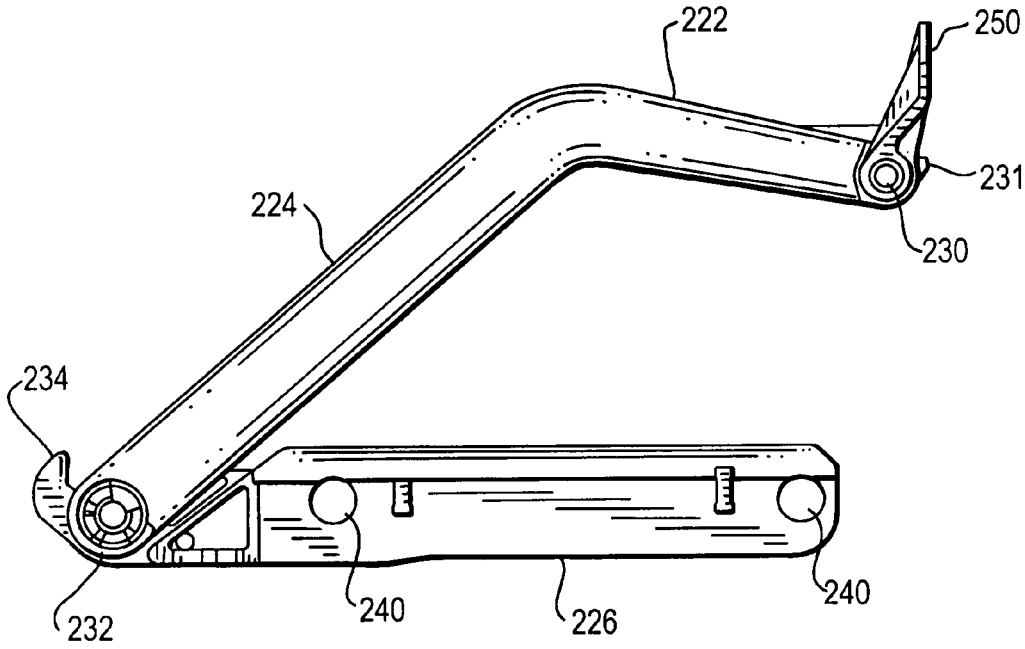
Figure 9C:
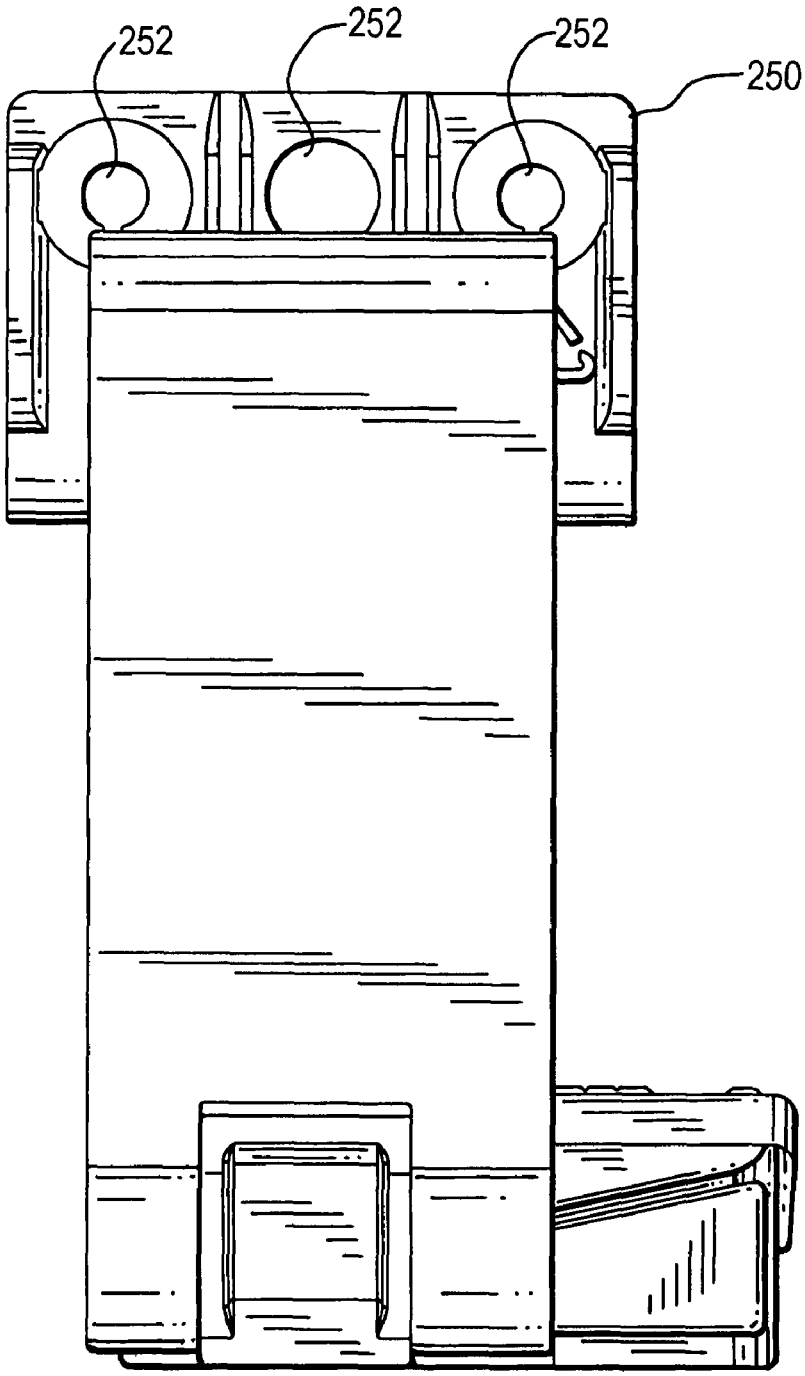
Figure 9D:
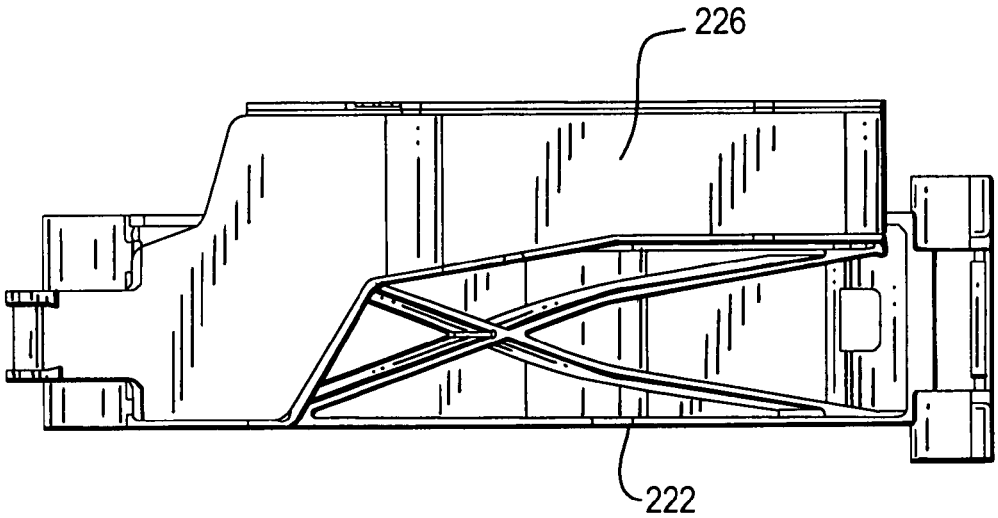
Figure 10:
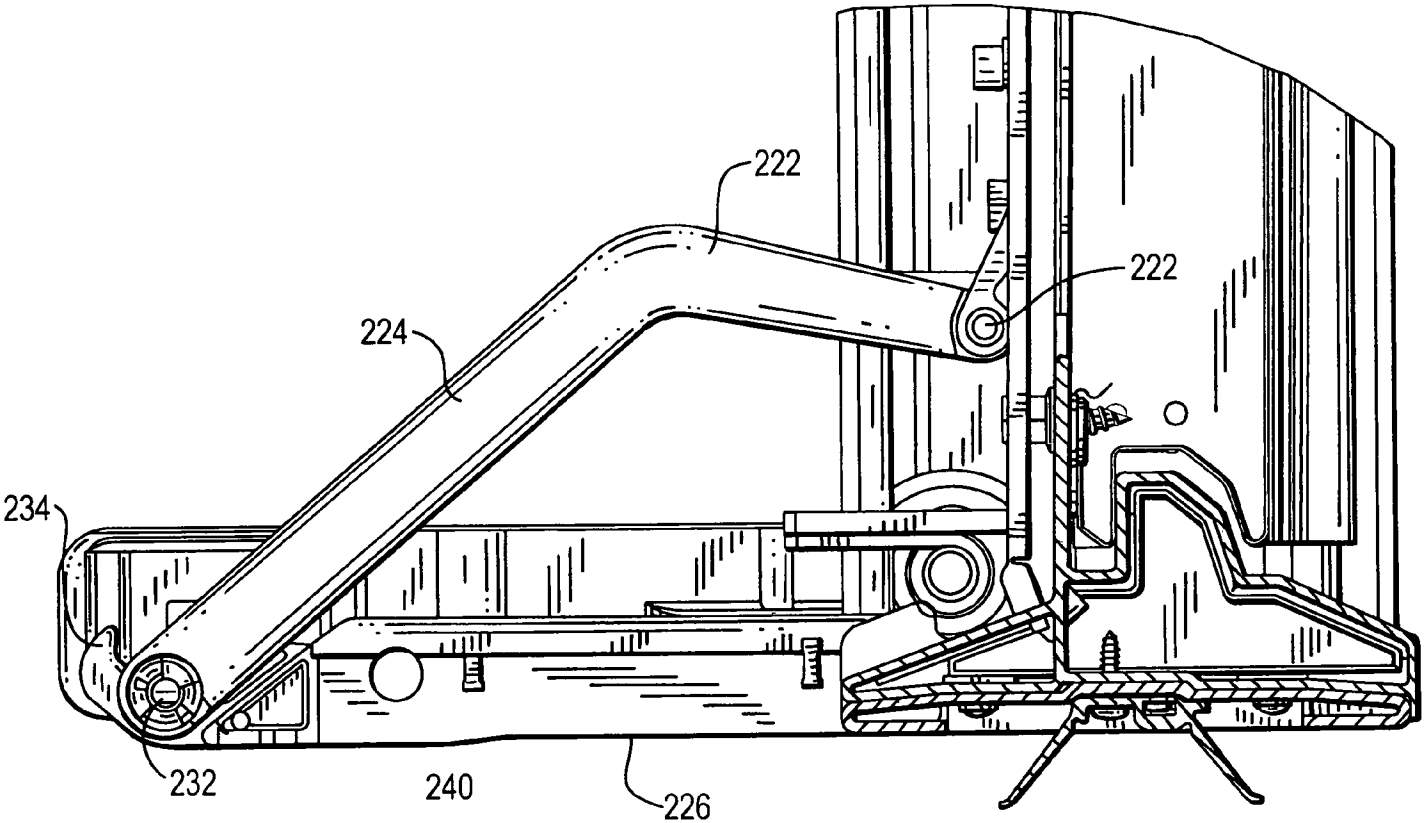
FIG. 10 shows a gate leaf with a connecting arrangement according to FIG. 9 attached to it, the gate leaf being in the closed position here.

FIGS. 9 and 10 show a connecting arrangement for a safety device according to another embodiment of the invention. FIG. 9*a* shows a perspective view of the connecting arrangement; FIG. 9*b* shows a side view of the connecting arrangement; FIG. 9*c* shows a rear view of the connecting arrangement; and FIG. 9*d* show a bottom view of the connecting arrangement. In the description of the connecting arrangement illustrated in FIGS. 9 and 10, the elements have the same numbers as the corresponding elements of the connecting arrangement explained on the basis of FIGS. 6 and 7.

Figure 7:
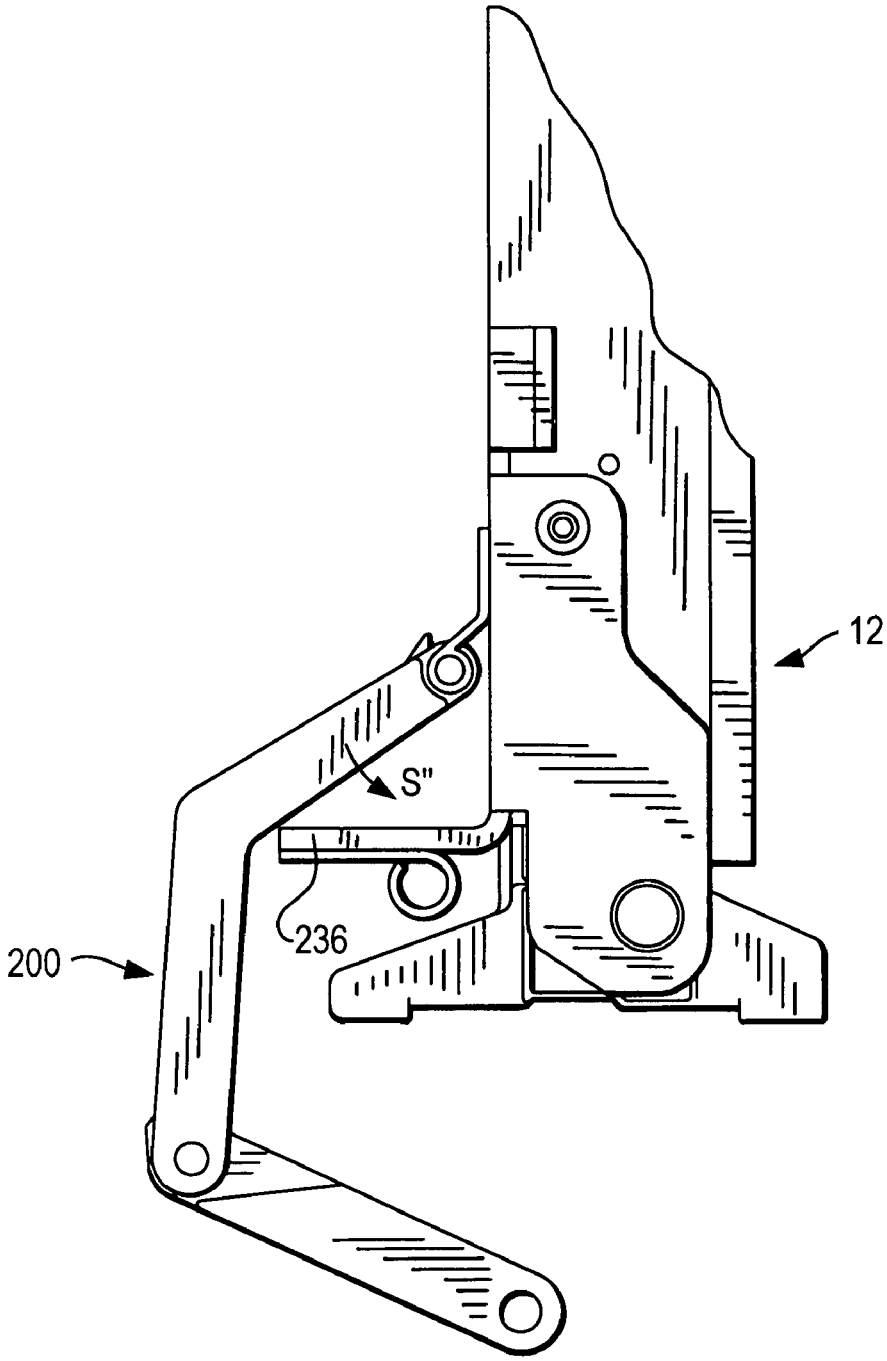
FIG. 7 shows a view of the connecting arrangement of an inventive safety device during the course of the closing movement.
Figure 8:
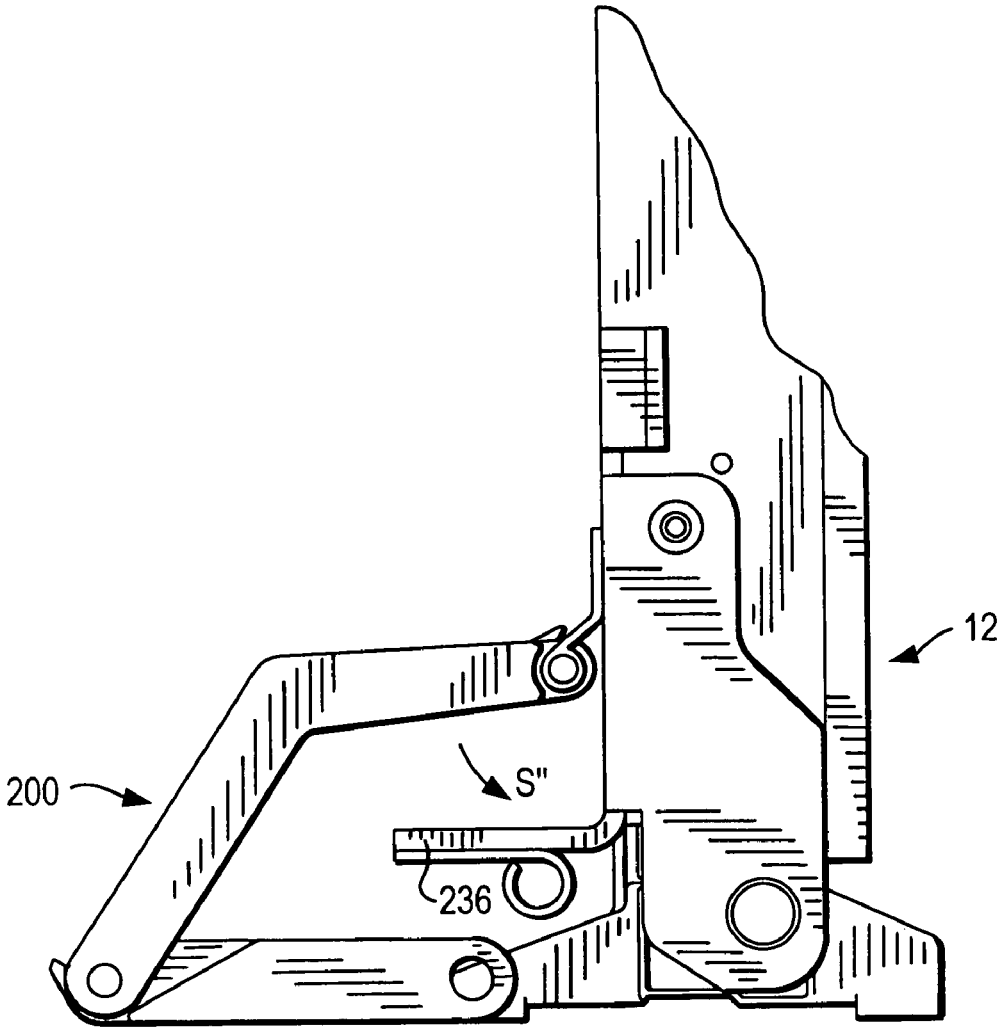
FIG. 8 shows a view of the connecting arrangement of an inventive safety device at the time the gate leaf arrives in the closed position.

The connecting arrangement shown in FIGS. 9 and 10 differs from the connecting arrangement explained on the basis of FIGS. 6 and 7 essentially in that the lever segment 226 is designed as a housing for the transmitter elements, deflector elements, and/or receiver elements of the safety device.

As can be seen especially clearly in FIGS. 9*a* and 9*b*, the housing-like lever segment 226 has two windows 240, which allow the signals propagating parallel to each other and parallel to the tilt axes of the gate leaf to enter and/or to leave the housing.

As is especially clear in FIG. 9*d*, the end area of the lever segment 226 facing away from the pivot axis 232 is offset in the direction of the tilt axes from the lever segment 222 to be attached to the gate leaf. This has the result that, when the gate leaf is in the closed position, the lever segment 226 can assume a position next to the gate leaf, as can be seen in FIG. 10.

Like the connecting arrangement explained on the basis of FIGS. 6 and 7, the connecting arrangement shown in FIGS. 9 and 10 can be mounted on the inside surface of the gate leaf by means of fastening elements 250. For this purpose, the fastening element 250 has a total of three holes 252, each of which is designed to accept a screw.

As a result of the design of the safety device described above, it is ensured during each phase of the closing movement, especially during the phase of travel along the arc-shaped guide rail section, that the transmitter arrangement 210 emits a signal which propagates underneath the edge which leads during the closing movement, so that the path along which this edge moves can be monitored without contact.

The invention is not limited to the embodiment explained on the basis of the drawings. On the contrary, it is also possible to use ultrasound transmitters for inventive safety devices. In addition, the threshold element can also have other dimensions, as long as sufficient flexural rigidity with respect to flexure in the plane perpendicular to the plane of the gate leaf is achieved. The door leaf can also be installed in an off-center position in the gate leaf. It is also possible that inventive safety devices could be used on tilting gates which have a rigid gate leaf, on rollup gates with a gate leaf which can be rolled up on a winding shaft, on folding gates, etc.

We claim:

1. A gate comprising a gate leaf movable between a closed position and an open position; and having a plurality of gate leaf elements which are tiltable with respect to each other around tilt axes which are parallel to each other;

guide rails used to guide the movement of the gate leaf between a closed position, wherein the gate leaf is in an essentially vertical plane, and an open position, wherein the gate leaf is in an essentially overhead horizontal plane, said guide rails having vertical sections which are essentially straight and essentially parallel to the lateral edges of the gate leaf when the gate is closed, the rails also having substantially straight, horizontal sections which are essentially parallel to the edges of the gate leaf when the gate is open, and the rails having curved sections which connect the straight sections;

the gate leaf comprising a door with a door leaf, wherein the door leaf can be swung around a pivot axis extending essentially perpendicular to the tilt axes; and when closed, the door leaf is accommodated in an opening in the gate leaf; and when closed, the door leaf extends essentially parallel to the plane of the gate leaf; and a stabilizing arrangement which opposes the deformation of the gate leaf; wherein the stabilizing arrangement has a threshold element, which when the gate leaf is in the closed position, rests on the floor of the opening closed by the gate leaf;

defines the bottom edge of the door opening; and is attached to the gate leaf elements adjacent in a first direction of the tilt axes to the door opening, the height of which threshold element in a second direction in which the pivot axis extends is, at least in the area of its edges which are essentially parallel to the tilt axes, less than 20 mm, wherein the overall height of the threshold element between the floor and the door leaf in the closed position is less than 22 mm, the width of the threshold element in a third direction that is perpendicular to the plane of the gate leaf in the closed position thereof is more than 150% of the thickness of the gate leaf in the third direction, over the entire thickness of the gate leaf and more than 80 mm, and wherein at least certain parts of the threshold element are made of a material of high tensile strength, such as steel, with a material thickness of 5 mm or less.

2. Gate according to claim 1, wherein the threshold element, at least sections of which are molded of a material with a tensile strength of more than 120 $N/mm^2$ is bent back in an area of at least one of the edges which extend essentially parallel to the tilt axes thereby forming a receptacle extending in the same direction as the tilt axes for accommodating a sealing element on the boundary surface which is at the bottom when the gate leaf is in the closed position.

3. Gate according to claim 2, wherein the threshold element has a channel between its lateral edges to receive a fastening section of the sealing element, the channel extending essentially parallel to the tilt axes and being open toward the bottom when the gate is in the closed position.

4. Gate according to claim 3, wherein lateral boundary walls of the channel are inclined toward the lateral edges of the threshold element, where they form an angle of less than 60° with a horizontal plane when the gate is in the closed position.

5. Gate according to claim 1, comprising a sealing element mounted in an area of a boundary surface of the threshold element which is at the bottom in the closed position, the sealing element being essentially parallel to the tilt axes and extending over the entire thickness of the gate leaf.

6. Gate according to claim 5, wherein the sealing element has a fastening section, at least part of which fits into the channel in the threshold element, and at least one sealing flap which proceeds and slants downward from the fastening section in opposite directions.

7. Gate according to claim 6, wherein, in the closed position, at least areas of at least one edge of at least one sealing flap is bent upward.

8. Gate according to claim 5, wherein a cable channel extends through the sealing element.

9. Gate according to claim 6, wherein at least one sealing flap is connected to the fastening section by at least one predetermined bending point of reduced material thickness.

10. Gate according to claim 1, wherein the threshold element is attached to the bottom edges of the gate leaf elements adjacent in the direction of the tilt axes to the door opening.

11. Gate according to claim 10, comprising a fastening element attached on a first side to the bottom edge of one of the gate leaf elements and on a second side to a top boundary surface of the threshold element.

12. Gate according to claim 11, wherein the fastening element has an upper boundary surface section which extends from a surface of the gate leaf which is on the outside when the gate is closed and slants downward toward the outside edge of the threshold element to an upper boundary surface element which extends from a surface of the door leaf which is on the inside when the gate is in the closed position and slants downward toward the inside edge of the threshold element, wherein at least one of the upper boundary surface sections, when the gate is closed, forms an angle of 10° or more, with the horizontal plane.

13. Gate according to claim 11, wherein the fastening element has a projection which fits into a recess in the bottom edge of the gate leaf elements, the recess being open at the bottom and parallel to the tilt axes.

14. Gate according to claim 13, wherein the fastening element has a receptacle located between a wall element resting against an inside surface of the gate leaf and the projection, the receptacle being configured to accept a projection located on the bottom edge of the gate leaf element.

15. Gate according to claim 1, wherein the door leaf has a plurality of door leaf elements which can tilt with respect to each other around axes collinear to the tilt axes.

16. Gate according to claim 15, wherein the door leaf elements have approximately the same shape, in a cross-sectional plane perpendicular to the tilt axes, as the gate leaf elements.

17. Gate according to claim 15, comprising a transition element attached to the door leaf element which is at the bottom when the gate leaf is in the closed position and which, when the door leaf is in the closed position, is located between the threshold element and the bottom door leaf element.

18. Gate according to claim 17, wherein the transition element has a sealing arrangement which rests against the threshold element when the door leaf is in the closed position.

19. Gate according to claim 18, wherein the sealing arrangement has a sealing element which, when the door leaf is in the closed position, rests against a forward boundary surface of the threshold element or a sealing element which, when the door leaf is in the closed position, rests against an upper boundary surface of the threshold element.

20. Gate according to claim 17, wherein the transition element, at least in an area of the outside surface of the gate leaf, has approximately the same shape in a cross-sectional plane perpendicular to the tilt axes as the fastening element.

21. Gate according to claim 1, wherein the stabilizing arrangement has at least one stabilizing element which is located above the door opening and which spans the door opening.

22. Gate according to claim 21, wherein the stabilizing element has a boundary surface which, when the gate leaf is in the closed position, is located approximately in a vertical plane.

23. Gate according to claim 22, wherein the stabilizing element is mounted in a gate leaf element located above the door opening and is attached to an inner boundary surface of a gate leaf element located above the door opening.

24. Gate with a gate leaf, which can be moved between an open position and a closed position and has a plurality of gate leaf elements which can tilt with respect to each other around tilt axes which are parallel to each other, and a door mounted in the gate leaf and comprising a door leaf, wherein when closed, the door leaf is received in an opening in the gate leaf; and when closed, the door leaf extends essentially parallel to the plane of the gate leaf; and a stabilizing arrangement which opposes the deformation of the gate leaf; wherein the stabilizing arrangement has a threshold element, which when the gate leaf is in the closed position, rests on the floor of the opening closed by the gate leaf;

comprises the bottom edge of the door opening; and is attached to the gate leaf elements adjacent in a first direction of the tilt axes to the door opening, the height of which threshold element in a second direction in which the pivot axis extends is, at least in an area of its edges which are essentially parallel to the tilt axes, less than 20 mm, and the width of the threshold element in a third direction perpendicular to the plane of the gate leaf in the closed position thereof is more than 150% of the thickness of the gate leaf in the third direction, over the entire thickness of the gate leaf and more than 80 mm, and wherein at least certain parts of the threshold element are made of a material of high tensile strength, such as steel, with a material thickness of 5 mm or less; further comprising a safety device which operates without contact for detecting objects or persons in a path of movement of the edge of the gate leaf which is in a leading position during the closing movement.

25. Gate according to claim 24, wherein the safety device has at least one transmitter arrangement for sending signals in a direction essentially parallel to the tilt axes and at least one receiver arrangement for receiving the signals sent by the transmitter arrangement, where the transmitter arrangement and the receiver arrangement are mounted in the area of opposite lateral edges of the gate leaf element.

26. Gate according to claim 25, wherein the transmitter arrangement comprises means for sending signals along two or more signal paths which are offset from each other in a direction perpendicular to the plane of the gate leaf and which are essentially parallel to the tilt axes.

27. Gate according to claim 26, comprising a common transmitter element for feeding at least two signal paths.

28. Gate according to claim 26, comprising at least two transmitter elements for feeding each at least one signal path.

29. Gate according to claim 26, comprising a common receiver element of the receiver arrangement for at least two signal paths.

30. Gate according to claim 25, wherein the transmitter arrangement comprises means for sending signals in the form of a signal cone with a beam angle of more than 2°.

31. Gate according to claim 25, wherein at least one element of the transmitter arrangement and at least one element of the receiver arrangement are attached by a connecting arrangement to the gate leaf so that they can pivot around a pivot axis which is essentially parallel to the tilt axes.

32. Gate according to claim 31, comprising a stop arrangement for limiting the pivoting movement of the element of the transmitter arrangement and of the element of the receiver arrangement whereby at least in one section of the path along which the edge of the gate leaf which leads during the closing movement travels, the pivotably attached element remains underneath this leading edge during the closing movement and essentially in the vertical plane which contains the leading edge.

33. Gate according to claim 31, wherein the connecting arrangement has a connecting lever attached pivotably to the gate leaf near the edge which leads during the closing movement, so that it can pivot around a pivot axis parallel to the tilt axes.

34. Gate according to claim 33, wherein the connecting lever, at least in one pivot position, extends across the edge of the gate leaf which leads during the closing movement.

35. Gate according to claim 33, wherein the connecting lever has two or more lever segments which lie in a plane perpendicular to the tilt axes and form an angle of less than 180 degrees with each other.

36. Gate according to claim 35, wherein at least two lever segments are connected pivotably to each other so that they aft pivot around a pivot axis parallel to the tilt axes, wherein the pivoting movement of the lever segments is limited by a stop arrangement.

37. Gate according to claim 33, wherein the connecting lever has a housing for at least one transmitter element, at least one receiver element, and at least one deflector element.

38. Gate according to claim 37, wherein the housing is mounted on the lever segment which is pivotably attached to the lever segment attached to the gate leaf.

39. Gate according to claim 37, wherein the housing has two or more windows, each window allowing at least one of the signals propagating along one of the signal paths to pass through.

40. Gate according to claim 36, wherein an end area of the lever segment facing away from the pivot axis, is offset in the direction of the tilt axis from the lever segment attached to the gate leaf.

41. Gate according to claim 31, wherein an element of the safety device attached to the connecting arrangement pivots automatically into the interior of the space closed by the gate leaf when the gate leaf reaches the closed position.

42. Gate according to claim 31, wherein the connecting arrangement gives way in a direction opposite the closing direction when striking an obstacle during the final phase of the closing movement.

43. Safety device in combination with a gate comprising a gate leaf movable between an open position and a closed position and having a plurality of gate leaf elements which tilt with respect to each other around tilt axes which are parallel to each other, and the gate leaf comprising a door with a door leaf, which with respect to the gate leaf elements adjacent to the gate leaf in the direction of the tilt axes, can be swung around a pivot axis which is essentially perpendicular to the tilt axes; and when closed, the door leaf is housed in an opening in the gate leaf; and when closed, the door leaf is parallel to the plane of the gate leaf; and a stabilizing arrangement which opposes the deformation of the gate leaf; wherein the stabilizing arrangement has a threshold element, which when the gate leaf is in the closed position, rests on the floor of the opening closed by the gate leaf;

forms a bottom edge of the door opening; and is attached to the gate leaf elements adjacent in a first direction of the tilt axes to the door opening, the height of which threshold element in a second direction in which the pivot axis extends is, at least in an area of its edges which are essentially parallel to the tilt axes, less than 20 mm, and the width of the threshold element in a third direction perpendicular to the plane of the gate leaf in the closed position thereof is more than 150% of the thickness of the gate leaf in the third direction, over the entire thickness of the gate leaf and more than 80 mm, and wherein at least certain parts of the threshold element are made of a material of high tensile strength, such as steel, with a material thickness of 5 mm or less, wherein the safety device operates without contact and detects objects or persons in a path of movement of the edge of the gate leaf which is in a leading position during the closing movement.

* * * * *